US008790510B2

(12) United States Patent
Hays et al.

(10) Patent No.: US 8,790,510 B2
(45) Date of Patent: Jul. 29, 2014

(54) MERCURY REMOVAL WITH AMINE SORBENTS

(75) Inventors: John Michael Hays, Bartlesville, OK (US); Joe B. Cross, Bartlesville, OK (US)

(73) Assignee: Phillips 66 Company, Houston, TX (US)

( * ) Notice: Subject to any disclaimer, the term of this patent is extended or adjusted under 35 U.S.C. 154(b) by 295 days.

(21) Appl. No.: 12/909,978

(22) Filed: Oct. 22, 2010

(65) Prior Publication Data

US 2011/0068048 A1 Mar. 24, 2011

Related U.S. Application Data

(60) Provisional application No. 61/256,201, filed on Oct. 29, 2009.

(51) Int. Cl.

| | |
|---|---|
| ***C10G 21/20*** | (2006.01) |
| ***C10G 21/28*** | (2006.01) |
| ***C10G 29/20*** | (2006.01) |
| ***C10G 19/02*** | (2006.01) |

(52) U.S. Cl.

CPC ..... *C10G 19/02* (2013.01); *C10G 2300/205* (2013.01); *C10G 2300/202* (2013.01); *C10G 2300/207* (2013.01)

USPC ..... 208/289; 208/251 R; 208/290

(58) Field of Classification Search

USPC ..... 196/46; 208/251 R, 253, 284, 286, 296, 208/289, 290; 210/702, 712, 717; 423/107, 423/210, 228, 229, 561 B; 505/856; 585/867

See application file for complete search history.

(56) References Cited

U.S. PATENT DOCUMENTS

| | | | | |
|---|---|---|---|---|
| 4,044,098 | A | 8/1977 | Miller et al. | |
| 4,483,834 | A * | 11/1984 | Wood | 423/228 |
| 4,709,118 | A * | 11/1987 | Yan | 585/820 |
| 4,915,818 | A | 4/1990 | Yan | |
| 4,962,276 | A * | 10/1990 | Yan | 423/210 |
| 6,350,372 | B1 | 2/2002 | Degnan et al. | |
| 6,770,119 | B2 | 8/2004 | Harada et al. | |
| 7,591,944 | B2 | 9/2009 | Carnell et al. | |
| 2007/0256980 | A1 | 11/2007 | Krogue et al. | |
| 2009/0217582 | A1 | 9/2009 | May et al. | |

FOREIGN PATENT DOCUMENTS

| | | |
|---|---|---|
| WO | WO02064705 A1 | 8/2002 |

OTHER PUBLICATIONS

PCT/US10/53701 International Search Report (Form PCT/ISA/220) dated Jan. 3, 2011.

* cited by examiner

*Primary Examiner* — Randy Boyer
(74) *Attorney, Agent, or Firm* — Phillips 66 Company

(57) ABSTRACT

Methods and apparatus relate to treatment of fluids to remove mercury contaminants in the fluid. Contact of the fluid with an amine that has absorbed a sulfur compound causes the mercury contaminants to be absorbed by the amine. Phase separation then removes from the fluid the amine loaded with the mercury contaminants such that a treated product remains.

13 Claims, 3 Drawing Sheets

MERCURY REMOVAL WITH AMINE SORBENTS

CROSS-REFERENCE TO RELATED APPLICATIONS

This application is a non-provisional application which claims benefit under 35 USC §119(e) to U.S. Provisional Application Ser. No. 61/256,201 filed Oct. 29, 2009, entitled "MERCURY REMOVAL WITH AMINE SORBENTS," which is incorporated herein in its entirety.

STATEMENT REGARDING FEDERALLY SPONSORED RESEARCH OR DEVELOPMENT

None

FIELD OF THE INVENTION

Embodiments of the invention relate to methods and systems for removing mercury from fluids.

BACKGROUND OF THE INVENTION

Presence of mercury in hydrocarbon streams can cause problems with downstream processing units as well as health and environmental issues. Removal of the mercury to achieve acceptable levels presents problems with prior techniques. Fixed bed solid sorbent applications for crude oil and heavy hydrocarbons tend to foul and become plugged. Prior sorbent particles utilized in fluidized bed applications still require separation of the particles from treated fluids. Such separation procedures rely on filtration that results in similar clogging issues as encountered with the fixed bed solid sorbent applications.

Therefore, a need exists for improved methods and systems for removing mercury from fluids.

SUMMARY OF THE INVENTION

In one embodiment, a method of removing mercury includes preparing a mixture by introducing a mercury-containing hydrocarbon liquid into contact with an aqueous liquid containing an amine that has absorbed sulfur such that the aqueous liquid thereby absorbs the mercury. Separation then divides the mixture into a hydrocarbon phase and an aqueous phase. Extracting the hydrocarbon phase separated from the aqueous phase provides a treated hydrocarbon liquid.

According to one embodiment, a method of removing mercury includes stripping a sour gas with a sulfur-lean amine. Hydrogen sulfide transfers from the sour gas to the sulfur-lean amine resulting in a treated gas and a sulfur-rich amine. The method further includes removing mercury from a mercury-containing hydrocarbon liquid by contacting the sulfur-rich amine with the mercury-containing hydrocarbon liquid to transfer mercury from the mercury-containing hydrocarbon liquid to the sulfur-rich amine, thereby resulting in a mercury loaded amine and a treated hydrocarbon liquid.

For one embodiment, a system for removing mercury includes a gas stripper that transfers a sulfur compound from gas input into the gas stripper to a sulfur-lean amine input into the gas stripper and produces an output of a sulfur-rich amine. In addition, the system includes a mercury removal unit that couples with the gas stripper to receive the sulfur-rich amine and introduces the sulfur-rich amine into contact with a mercury-containing hydrocarbon liquid input into the mercury removal unit to transfer mercury from the mercury-containing hydrocarbon liquid to the sulfur-rich amine. The mercury removal unit includes first and second outlets disposed based on separation of a hydrocarbon phase and an aqueous phase within the mercury removal unit to produce through the first outlet a mercury loaded amine and produce through the second outlet a treated hydrocarbon liquid.

BRIEF DESCRIPTION OF THE DRAWINGS

The invention, together with further advantages thereof, may best be understood by reference to the following description taken in conjunction with the accompanying drawings.

DETAILED DESCRIPTION OF THE INVENTION

Embodiments of the invention relate to treatment of fluids to remove mercury contaminants in the fluid. Contact of the fluid with an amine that has absorbed a sulfur compound causes the mercury contaminants to be absorbed by the amine. Phase separation then removes from the fluid the amine loaded with the mercury contaminants such that a treated product remains.

Figure 1:
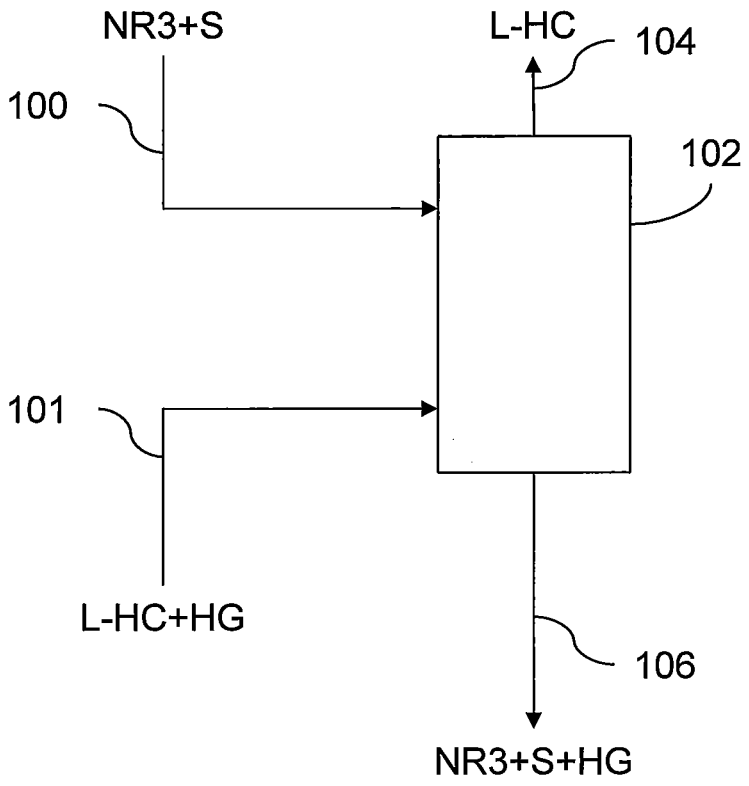
FIG. 1 is a schematic of a treatment system for removing mercury from liquid hydrocarbons with a sulfur-containing amine solution, according to one embodiment of the invention.

FIG. 1 shows a schematic of an exemplary treatment system. The system includes a mercury removal unit 102 coupled to supplies of a sulfur-containing amine solution (NR3+S) 100 and a mercury-containing hydrocarbon liquid (L–HC+HG) 101. As used herein, mercury within the mercury-containing hydrocarbon liquid 101 refers to elemental mercury (Hg) and/or compounds with mercury. For some embodiments, the mercury-containing hydrocarbon liquid 101 contains the mercury at a concentration of at least about 1.0 parts per billion by weight (ppbw), at least about 10.0 ppbw, or at least about 100.0 ppbw. Crude oil provides one example of the mercury-containing hydrocarbon liquid 101, which includes liquid hydrocarbons contaminated with the mercury.

The sulfur-containing amine solution 100 contains amines that have absorbed sulfur. The amines capable of absorbing the sulfur and hence suitable for use include aliphatic amines, such as alkanol amines. Examples of the amines include at least one of monoethanolamine (MEA), diethanolamine (DEA), triethanolamine (TEA), diglycolamine (DGA), diisopropylamine (DIPA), and monodiethanolamine (MDEA).

The sulfur retained by the sulfur-containing amine solution 100 as a result of the amines may include one or more compounds containing sulfur. For some embodiments, the compounds have a formula $R^1$—S—$R^2$ with $R^1$ and $R^2$ each independently selected from the group consisting of hydrogen, an alkyl, an alkenyl, an alkynyl, and an aryl. Examples of the sulfur referred to herein include at least one of hydrogen sulfide and dimethyl sulfide.

In operation, the mercury removal unit 102 receives the sulfur-containing amine solution 100 and the mercury-containing hydrocarbon liquid 101 that are contacted together within the mercury removal unit 102 to produce a treated hydrocarbon liquid (L–HC) 104 and a mercury and sulfur loaded amine (NR3+S+HG) 106. The mercury removal unit 102 provides a contacting zone where the sulfur-containing amine solution 100 and the mercury-containing hydrocarbon liquid 101 form a mixture. The mercury removal unit 102 includes a contactor or mixer such as a packed column, tray column, mixing valve or static mixer forming the contacting zone. Within the mixture created in the mercury removal unit 102, the mercury transfers from the mercury-containing hydrocarbon liquid 101 to the sulfur-containing amine solution 100 that absorbs the mercury.

The treated hydrocarbon liquid 104 and the mercury and sulfur loaded amine 106 exit the mercury removal unit 102 upon being divided from one another based on separation of the mixture into respective hydrocarbon and aqueous phases. The treated hydrocarbon liquid 104 and the mercury and sulfur loaded amine 106 hence flow from the mercury removal unit 104 through outlets disposed based on the separation of the hydrocarbon phase from the aqueous phase within the mercury removal unit 102. While the contactor or mixer depending on type may enable subsequent separation of the mixture formed in the contacting zone, a settler or separator of the mercury removal unit 102 may accomplish aforementioned separation in some embodiments.

The treated hydrocarbon liquid 104 contains less of the mercury and has a lower mercury concentration than the mercury-containing hydrocarbon liquid 101 that is introduced into the mercury removal unit 102. For example, the treated hydrocarbon liquid may contain less than 70% of the mercury contained in an equal volume of the mercury-containing hydrocarbon liquid 101. Variables that influence removal of the mercury from the mercury-containing hydrocarbon liquid 101 include temperature of the mixture and amount of sulfur loading of the amine.

Raising sulfur content in the sulfur-containing amine solution 100 increases percentage of the mercury removed from the mercury-containing hydrocarbon liquid 101. The sulfur content in the sulfur-containing amine solution 100 may range from greater than 0 parts per million by weight of the sulfur up to a saturation limit in which the amine will not absorb more of the sulfur. In some embodiments, the sulfur-containing amine solution 100 contains at least about 250 parts per million by weight of the sulfur, such as at least about 8500 parts per million by weight of hydrogen sulfide.

Further, elevating temperature of the mixture increases percentage of the mercury removed from the mercury-containing hydrocarbon liquid 101. The sulfur-containing amine solution 100 and the mercury-containing hydrocarbon liquid 101 may be contacted at a temperature in which the mixture remains liquid, such as from about 0° C. up to a boiling point of constituents in the mixture or below a temperature at which the sulfur desorbs from the amine. For some embodiments, contacting of the sulfur-containing amine solution 100 and the mercury-containing hydrocarbon liquid 101 together in the mixture occurs at a temperature of at least about 40° C., between about 20° C. and about 100° C., or between about 70° C. and about 90° C.

Figure 2:
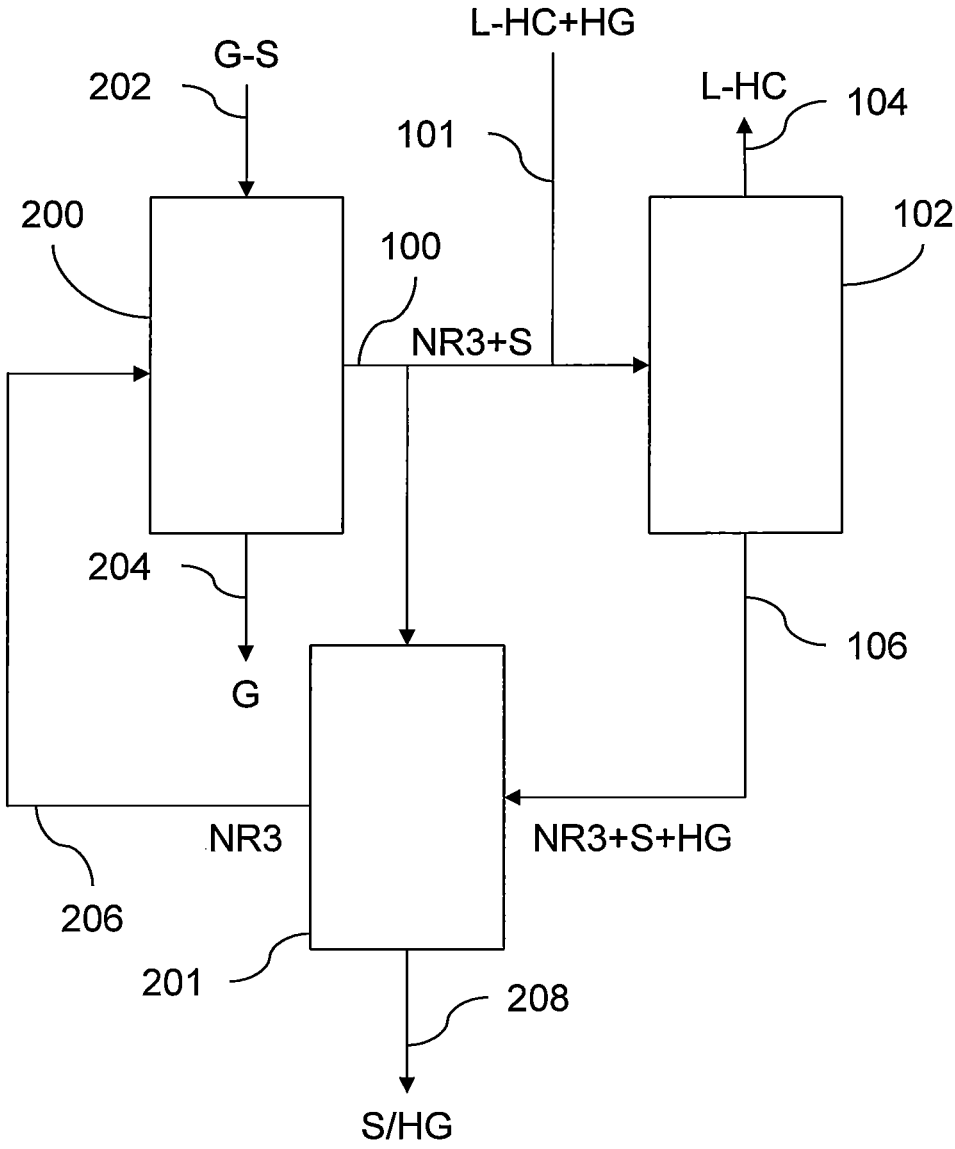
FIG. 2 is a schematic of a treatment system including preparation and regeneration of a sulfur-containing amine solution for removing mercury from liquid hydrocarbons, according to one embodiment of the invention.

FIG. 2 illustrates another treatment and recycling system including preparation and regeneration of an amine solution. For conciseness in description, common reference numbers identify components shown in FIGS. 1 and 2 that are alike. The treatment and recycling system includes at least one of a gas stripper 200 and a regeneration unit 201 in addition to the mercury removal unit 102.

In operation, the gas stripper 200 receives a sulfur-containing gas 202 and outputs a treated gas 204 with sulfur removed as a result of contact between the sulfur-containing gas 202 and a sulfur-lean amine 206 input into the gas stripper 200. As described herein, the sulfur-lean amine 206 having absorbed the sulfur results in a sulfur-rich amine output from the gas stripper 200 as the sulfur-containing amine solution 100. At least part of the sulfur-containing amine solution 100 mixes with the mercury-containing hydrocarbon liquid 101 such that the treated hydrocarbon liquid 104 and the mercury and sulfur loaded amine 106 are produced via the mercury removal unit 102.

The regeneration unit 201 couples with the mercury removal unit 102 to receive flow of the mercury and sulfur loaded amine 106. The gas stripper 200 also couples to the regeneration unit 201, which resupplies part or all of the sulfur-lean amine 206 once the regeneration unit 201 strips the mercury and the sulfur from the mercury and sulfur loaded amine 106. In some embodiments, heating the mercury and sulfur loaded amine 106 in the regeneration unit 201 to temperatures, such as between about 100° C. and about 180° C., desorbs the sulfur and the mercury that are then output from the regeneration unit 201 as waste 208. The heating produces a vapor phase containing the sulfur and the mercury that vaporizes such that the waste includes an overhead from the regeneration unit 201. Due to liquid separation from the overhead, the sulfur, such as the hydrogen sulfide, exits from the regeneration unit 208 as gas in the waste 208 for conversion into elemental sulfur via further processing, which may include a Claus reaction unit. At least some of the sulfur may react upon the heating with at least some of the mercury to form solid particles of mercury sulfide that may be filtered out as the waste 208.

Directing flow along various pathways to and from the regeneration unit 201 enables establishing desired flow rates of the sulfur-containing amine solution 100 to the mercury removal unit 102 and/or the sulfur-lean amine 206 to the gas stripper 200. In some embodiments, a portion of the sulfur-containing amine solution 100 bypasses the mercury removal unit 102 and passes to the regeneration unit 201 where the sulfur is desorbed from the amine that is then utilized for replenishing the sulfur-lean amine 206. For example, heating the sulfur-containing amine solution 100 in the regeneration unit 201 to temperatures, such as between about 100° C. and about 180° C., desorbs the sulfur that is then output from the regeneration unit 201 as the waste 208

Figure 3:
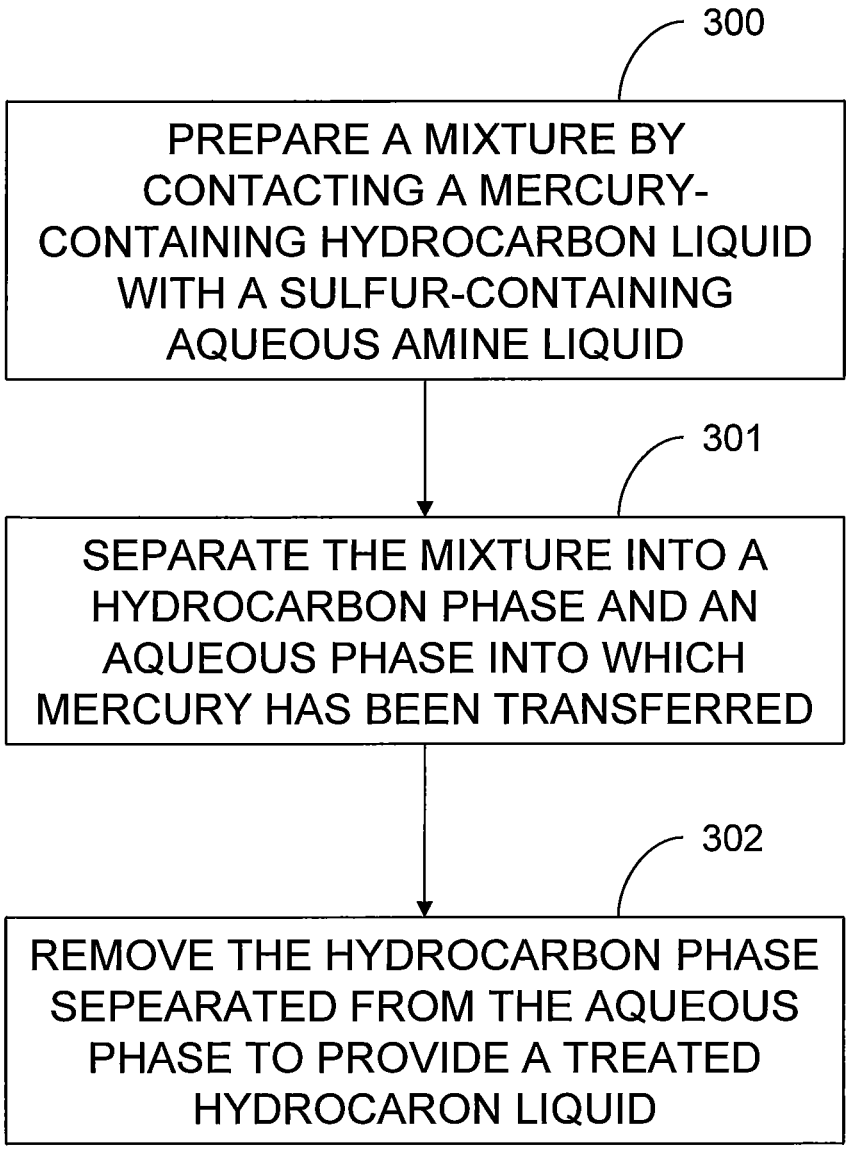
FIG. 3 is a flow chart illustrating a method of treating a liquid utilizing a sulfur-containing amine solution to remove mercury from the liquid, according to one embodiment of the invention.

FIG. 3 shows a flow chart illustrating a method of treating a liquid utilizing a sulfur-containing amine solution to remove mercury from the liquid. In a liquid-liquid contact step 300, a mercury-containing hydrocarbon liquid mixes with a sulfur-containing aqueous amine liquid. Phase separation step 301 includes dividing of the mixture into a hydrocarbon phase and an aqueous phase into which mercury has been transferred from the hydrocarbon-containing liquid. Next, removing the hydrocarbon phase separated from the aqueous phase to provide a treated hydrocarbon liquid occurs in extraction step 302.

EXAMPLES

Bottle tests were performed with about 3.0 grams of either a decane or light sweet crude oil mixed in contact with about 0.3 grams of diethanol amine (DEA) that had absorbed hydrogen sulfide. After mixing, settling permitted phase separation. Mercury concentrations were measured in the decane or the light sweet crude oil before the mixing and then upon collection of the decane or the light sweet crude oil that were isolated following the phase separation. A percentage of mercury removed was determined based on the mercury concentrations that were measured. Temperature of the mixing and concentration of the hydrogen sulfide that had been absorbed by the DEA were varied and influenced results for the percentage of mercury removed. Tables 1 and 2 show the results obtained with Table 1 corresponding to the bottle tests performed to remove the mercury from the decane using the DEA that had absorbed about 8500 parts per million (ppm) of the hydrogen sulfide and Table 2 being based on the bottle tests performed to remove the mercury from the light sweet crude oil.

TABLE 1

| Temperature (° C.) | Initial Hg (ppbw) | Final Hg (ppbw) | % Hg Removed |
|---|---|---|---|
| 23 | 1649 | 772 | 53.1 |
| 40 | 1695 | 460 | 72.9 |
| 70 | 1807 | 157 | 91.3 |
| 90 | 1704 | 94 | 94.5 |

TABLE 2

| $H_2S$ (ppm) | Temperature (° C.) | Initial Hg (ppbw) | Final Hg (ppbw) | % Hg Removed |
|---|---|---|---|---|
| 288 | 23 | 777 | 659 | 15 |
| 8568 | 23 | 777 | 329 | 58 |
| 288 | 70 | 766 | 589 | 23 |
| 8568 | 70 | 766 | 168 | 78 |

The preferred embodiment of the present invention has been disclosed and illustrated. However, the invention is intended to be as broad as defined in the claims below. Those skilled in the art may be able to study the preferred embodiments and identify other ways to practice the invention that are not exactly as described herein. It is the intent of the inventors that variations and equivalents of the invention are within the scope of the claims below and the description, abstract and drawings are not to be used to limit the scope of the invention.

The invention claimed is:

1. A method comprising:

preparing a mixture by introducing a mercury-containing hydrocarbon liquid into contact with an aqueous liquid containing an amine that has absorbed sulfur, wherein the aqueous liquid thereby absorbs mercury;

in a mercury removal unit, separating the mixture into a hydrocarbon phase and an aqueous phase;

extracting the hydrocarbon phase separated from the aqueous phase to provide a treated hydrocarbon liquid;

bypassing the mercury removal unit with a portion of the aqueous liquid containing the amine that has absorbed sulfur and directing the portion into a regeneration unit;

in the regeneration unit, desorbing sulfur and mercury from the aqueous liquid containing the amine; and recycling the aqueous liquid containing the amine by directing it from the regeneration unit to a gas stripper unit.

2. The method according to claim 1, further comprising stripping a sour gas with the amine, wherein hydrogen sulfide transfers from the sour gas to the amine to provide treated gas and the aqueous liquid.

3. The method according to claim 1, wherein the amine is diethanol amine.

4. The method according to claim 1, wherein the amine is diethanol amine, which has absorbed hydrogen sulfide.

5. The method according to claim 1, wherein the aqueous liquid contains at least 250 parts per million by weight of the sulfur.

6. The method according to claim 1, wherein the mercury-containing hydrocarbon liquid and the aqueous liquid are contacted while at a temperature of at least 40° C.

7. The method according to claim 1, wherein the mercury-containing hydrocarbon liquid and the aqueous liquid are contacted while at a temperature of at least 40° C. and the aqueous liquid contains at least 250 parts per million by weight of the sulfur.

8. The method according to claim 1, wherein the treated hydrocarbon liquid contains less than 70% of the mercury contained in an equal volume of the mercury-containing hydrocarbon liquid.

9. The method according to claim 1, wherein the amine has absorbed the sulfur in a compound having a formula $R^1$—S—$R^2$ and $R^1$ and $R^2$ are each independently selected from the group consisting of hydrogen, an alkyl, an alkenyl, an alkynyl, and an aryl.

10. A method comprising:

in a gas stripper unit, stripping a sour gas with a sulfur-lean amine, wherein hydrogen sulfide transfers from the sour gas to the sulfur-lean amine resulting in a treated gas and a sulfur-rich amine;

in a mercury removal unit, removing mercury from a mercury-containing hydrocarbon liquid by contacting the sulfur-rich amine with the mercury-containing hydrocarbon liquid to transfer mercury from the mercury-containing hydrocarbon liquid to the sulfur-rich amine, thereby resulting in a mercury loaded amine and a treated hydrocarbon liquid;

bypassing the mercury removal unit with a portion of the sulfur-rich amine and directing the portion of the sulfur-rich amine into a regeneration unit;

in the regeneration unit, desorbing sulfur and mercury from a combination of the portion of the sulfur-rich amine and the mercury loaded amine; and recycling the sulfur-lean amine by directing it from the regeneration unit to the gas stripper unit.

11. The method according to claim 10, wherein the sulfur-rich amine contains at least 8500 parts per million by weight of the hydrogen sulfide.

12. The method according to claim 10, wherein the sulfur-rich amine includes the hydrogen sulfide with at least one of monoethanolamine, diethanolamine, triethanolamine, diglycolamine, and monodiethanolamine.

13. The method according to claim 10, wherein the sulfur-rich amine includes the hydrogen sulfide with diethanolamine, the mercury-containing hydrocarbon liquid and the sulfur-rich amine are contacted while at a temperature of at least 70° C., and the sulfur-rich amine contains at least 8500 parts per million by weight of the hydrogen sulfide.

* * * * *